United States Patent [19]

Okabayashi et al.

[11] Patent Number: 4,741,638

[45] Date of Patent: May 3, 1988

[54] INK RIBBON FEEDING AND LIFTING DEVICE OPERATED BY A SINGLE REVERSIBLE MOTOR

[75] Inventors: Mitumasa Okabayashi; Norio Shiga, both of Tokyo, Japan

[73] Assignee: Tokyo Juki Industrial Co., Ltd., Tokyo, Japan

[21] Appl. No.: 930,074

[22] Filed: Nov. 12, 1986

Related U.S. Application Data

[63] Continuation of Ser. No. 599,991, Apr. 13, 1984, abandoned.

[51] Int. Cl.[4] ..... B41J 23/34

[52] U.S. Cl. ..... 400/185; 400/212; 400/225; 400/236.1

[58] Field of Search ..... 400/185, 207, 212, 225, 400/236.1, 697.1

[56] References Cited

U.S. PATENT DOCUMENTS

| | | | |
|---|---|---|---|
| 4,010,839 | 3/1977 | Guerrini et al. | 400/207 |
| 4,101,006 | 7/1978 | Jensen et al. | 400/144.3 |
| 4,247,210 | 1/1981 | Kacmarcik et al. | 400/697.1 X |
| 4,329,072 | 5/1982 | Kacmarcik | 400/212 X |
| 4,472,073 | 9/1984 | Valle et al. | 400/212 X |
| 4,611,938 | 9/1986 | Rettke et al. | 400/185 X |

FOREIGN PATENT DOCUMENTS

| | | | |
|---|---|---|---|
| 42572 | 12/1979 | Japan . | |
| 0126183 | 7/1983 | Japan | 400/225 |

OTHER PUBLICATIONS

IBM Technical Disclosure Bulletin, "Variable Lift and Feed Increment Ribbon/Correction Mechanism", Greenlief et al., vol. 26, No. 3B, Aug. 1983, pp. 1580–1582.

*Primary Examiner*—Ernest T. Wright, Jr.

*Attorney, Agent, or Firm*—Tarolli, Sundheim & Covell

[57] ABSTRACT

This application discloses an inked ribbon operation device in a printer in which a carriage having printing means is moved in parallel to the platen to perform printing, a reversible motor is supported on the carriage, a pair of spaced ribbon shafts are rotatably supported on the carriage for re-winding the ribbon from one ribbon shaft to the other ribbon shaft, a guide member is supported for holding the inked ribbon between the pair of ribbon shafts for moving the ribbon between the printing position and printed area viewing position, ribbon feed means is disposed between the motor and the ribbon shafts for rotating the ribbon shafts in response to the rotation of the motor in the forward direction, first connection means is disposed between the motor and guide member for moving the guide member to the raised position in response to the rotation of the motor in the forward direction, second connection means is disposed between the motor and guide member for moving the guide member to the lowered position in response to the rotation of the motor in the forward direction and a drive circuit is provided for rotating the motor in the forward direction in response to a printing command and for rotating the motor in the reverse direction at the completion of printing.

10 Claims, 4 Drawing Sheets

INK RIBBON FEEDING AND LIFTING DEVICE OPERATED BY A SINGLE REVERSIBLE MOTOR

This is a continuation of co-pending application Ser. No. 599,991 filed on Apr. 13, 1984, now abandoned.

BACKGROUND OF THE INVENTION

This invention relates to an inked ribbon (which will be referred to as "ribbon" hereinbelow) operation device in a serial printer and more particularly, to a ribbon operation device in a printer for performing ribbon feed and lifting.

In known serial printers, a ribbon is fixedly secured at the opposite ends thereof to a pair of ribbon shafts rotatably supported on a carriage, and as printing operation proceeds, the ribbon is paid out from one of the ribbon shafts so as to pass across the front of printing means, such as a printing hammer or printing wire, is wound about the other ribbon shaft and is then lowered from the position in the front of the printing means so that the printed area of a printing medium may be visible when the printing operation is interrupted. However, the ribbon winding-up, transfer, lifting and lowering operations have to be performed by separate means, respectively, and thus, known inked ribbon operation devices require a complicated mechanism and are expensive.

SUMMARY OF THE INVENTION

Therefore, the present invention is to provide a simpler and less expensive inked ribbon operation device in which the ribbon winding-up, transfer and lifting operations can be selectively carried out in response to the rotation of a motor in forward and reverse directions.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENT OF THE INVENTION

Figures 1, 8:
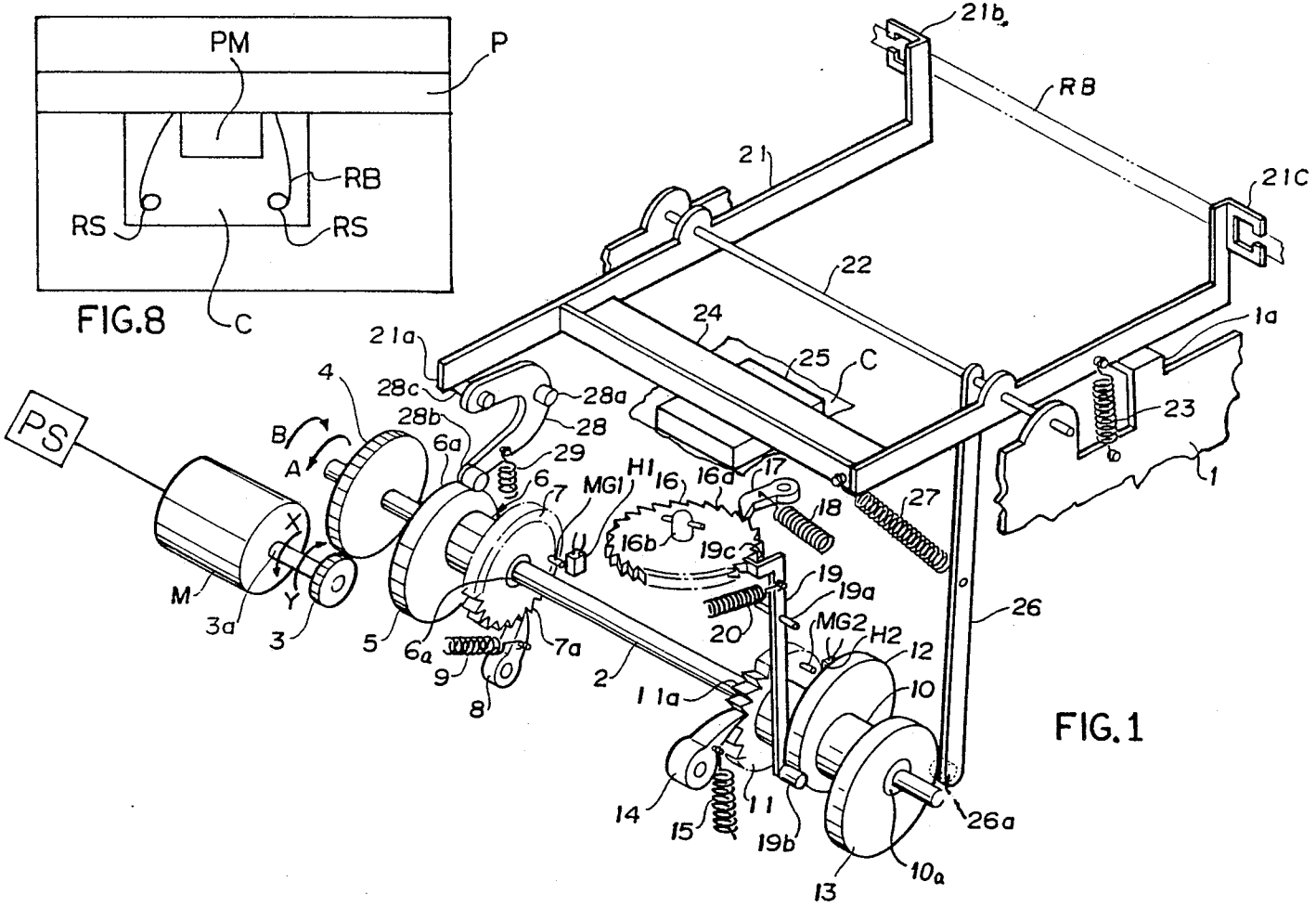
FIG. 1 is a fragmentary perspective view of a first embodiment of the inked ribbon operation device constructed in accordance with the principle of the invention.
FIG. 8 is a schematic illustration of a printing apparatus.
Figure 2:
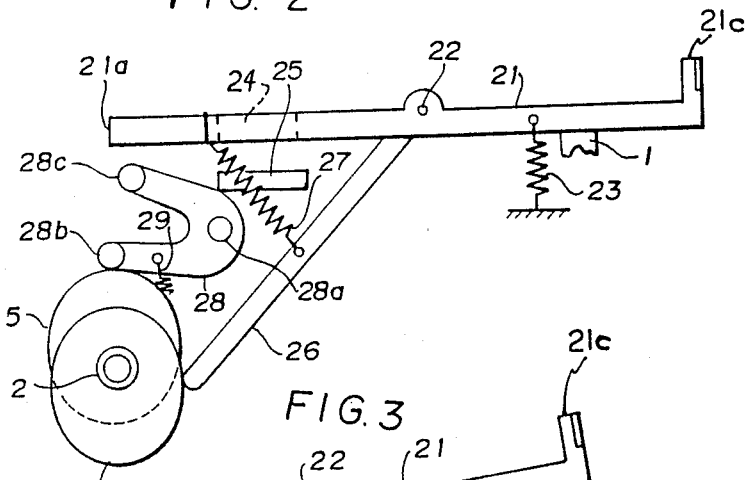
FIG. 2 is a schematic side elevational view showing the ribbon guide member of the device in its lowered position.
Figure 3:
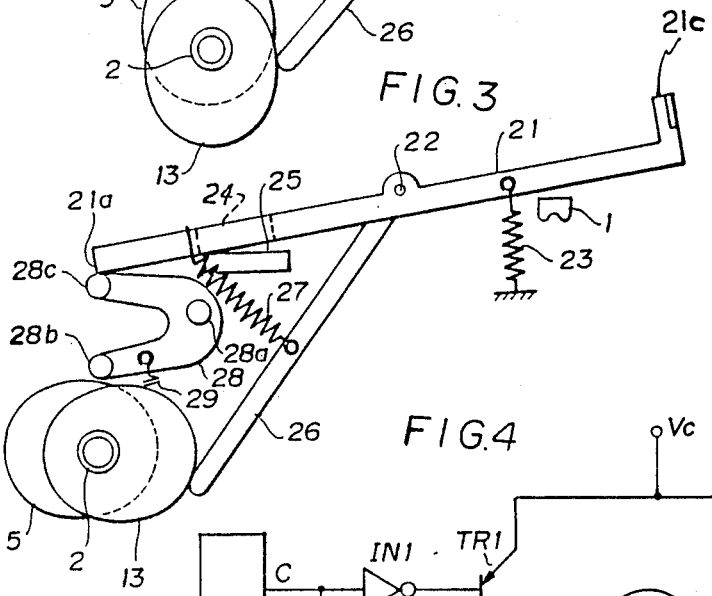
FIG. 3 is similar to FIG. 2, but shows the ribbon guide member in its raised position.

The preferred embodiments of the invention will be now described referring to the accompanying drawings and more particularly to FIGS. 1 to 3 thereof in which the first embodiment of the inked ribbon operation device of the invention is shown. A shaft 2 is supported on the carriage C (FIG. 8) for rotation about a fixed axis parallel to the movement path of the carriage C which is in turn adapted to move horizontally in parallel to the platen P (FIG. 8). The shaft 2 (FIG. 1) is connected at one axial end thereof through gears 3, 4 to the drive shaft 3*a* of a DC motor M fixedly mounted on the carriage C. A rotary member 6 is mounted on the shaft 2 adjacent to and inwardly spaced from the gear 4 through one-way bearings, indicated schematically at 6*a*, which rotate following the rotation of the shaft 2 only in the direction of the arrow A. Another rotary member 10 is mounted at the other end of the shaft 2 through one-way bearings, indicated schematically at 10*a*, which are adapted to follow the rotation of the shaft 2 only in the direction of the arrow B. An eccentric cam 5 and a ratchet gear 7 are secured to the opposite sides of the rotary member 6 in an axially spaced relationship. A ratchet 8 is urged resiliently against one of the teeth 7*a* on the ratchet gear 7 under the force of a spring 9 to prevent normal rotation of the rotary member 6 in the direction of the arrow B. A ratchet gear 11 and eccentric cams 12, 13 are fixedly mounted on the rotary member 10 in an axially spaced relationship and a ratchet 14 is resiliently urged against one of the teeth 11*a* on the ratchet gear 11 under the force of a spring 15 to prevent normal rotation of the rotary member 10 in the direction of the arrow A. Fixedly secured to one side of the ratchet gears 7, 11, respectively, are magnets MG1 and MG2. Magnetic sensitive elements H1, H2 are positioned adjacent to the movement paths of the magnets MG1, MG2, to respectively detect predetermined stop positions of the ratchet gears 7, 11. A ratchet gear 16 is suitably supported on the carriage C above the shaft 2 for rotation about a vertical support shaft 16*b* and a ratchet 17 is resiliently urged against one of the teeth 16*a* on the ratchet gear 16 under the force of a spring 18 to prevent normal rotation of the ratchet gear 16 in the counterclockwise direction (as seen in FIG. 1). Connected to the shaft 16*b* is one of a pair of ribbon shafts, indicated schematically at RS in FIG. 8, which have the opposite ends of a ribbon RB anchored thereto whereby when the ribbon RB is paid out from one of the ribbon shafts RS, the other ribbon shaft RS takes up the ribbon RB thereon. A feed arm 19 (FIG. 1) is supported on the carriage C for rotation about a shaft 19*a* which is parallel to the shaft 2 and the upper end of the arm 19 is formed with a pawl portion 19*c* adapted to selectively engage with teeth 16*a* on the ratchet gear 16. The lower end of the feed arm 19 is formed with a contact portion 19*b* adapted to be resiliently urged against the cam face on the eccentric cam 12 in face-to-face contact under the force of a spring 20. The feed arm 19 is biased by spring 20 to cause the contact portion 19*b* thereon to abut against the cam face on the eccentric cam 12 whereby when the eccentric cam 12 rotates to rotate the feed arm 19 in the counterclockwise direction (as seen in FIG. 1), the spring 20 urges the pawl portion 19*c* to engage with one of the teeth 16*a* on the ratchet gear 16 which in turn rotates the ratchet gear 16 in the counterclockwise direction (as seen in FIG. 1). A ribbon guide member 21 positioned between the printing means PM and platen P and having guide frames 21*b*, 21*c* for guiding the ribbon RB is supported on a stationary shaft 22 parallel to the shaft 2 for rocking about the shaft 22. A spring 23 is anchored at its opposite ends to the ribbon guide member 21 and an engaging portion 1*a* of the carriage machine framework or body 1 to urge the ribbon guide member 21 against the carriage machine framework engaging portion 1*a* whereby the ribbon RB trained about the guide frames 21*b*, 21*c* is held in a position below the printing zone defined by the opposing printing means PM and platen P (FIG. 8).

A magnetically attractable frame member 24 is fixedly secured to the rear portion of the ribbon guide member 21 and a magnet 25 is mounted on the carriage C right below the magnetically attractable frame member 24. When the frame member 24 and magnet 25 are in contact with each other they are in the position as shown in FIG. 3, and the attraction of the magnet 25 holds the ribbon RB trained about the guide frames 21*b*, 21*c* in the printing position defined between the opposing printing means PM and platen P (with the ribbon RB in the raised position).

A link 26 is pivoted at the upper end thereof to shaft 22 supported on the ribbon guide member 21 for moving the ribbon guide member 21 between the lowered position (FIG. 2) and the raised position (FIG. 3). The lower end of the link 26 is formed with a contact area 26*a* adapted to contact the cam face on the eccentric cam 13. A spring 27 extends between the ribbon guide member 21 and link 26 to urge the contact area 26*a* to abut against the cam face on the eccentric cam 13. For moving the ribbon guide member 21 downwardly to its lowered position, a substantially U-shaped lift arm 28 is provided with the curved portion of the U-shape supported on the carriage body 1 for rotation about a fixed shaft 28*a* extending parallel to the shaft 2. One or the upper end of the lift arm 28 is formed with a pushing-up area 28C adapted to engage a contacting portion 21*a* extending from the rear end of the ribbon guide member 21. The other or lower end of the lift arm 28 is formed with a contacting portion 28*b* adapted to contact the cam face on the eccentric cam 5. A spring 29 urges the lift arm 28 to rotate in the counterclockwise direction about the shaft 28*a* (as seen in FIG. 1) to thereby cause the contacting portion 28*b* to abut against the cam face on the eccentric cam 5.

In the rotary member 6, the proximate rotation angle defined between the magnet MG1 and magnetic sensitive element H1 corresponds to the phase in which the contacting portion 28*b* of the lift arm 28 assumes a minimum eccentric distance with respect to the eccentric cam 5. In the rotary member 10, the proximate rotation angle defined between the magnet MG2 secured to the ratchet gear 11 and the magnetic sensitive element H2 corresponds to the phase in which the contacting portion 19*b* of the feed arm 19 assumes the minimum eccentric distance with respect to the eccentric cam 12 and the contact area 26*a* of the link 26 assumes the minimum eccentric distance with respect to the eccentric cam 13, respectively.

The moment relationship of the tension in the springs 23, 27 and the attraction of the magnet 25 with respect to the frame member 24 about the shaft 22 is as follows: In the position as shown in FIG. 2, the spring 23 applies a force to the ribbon guide member 21 greater than that which the spring 27 and magnet 25 apply to the ribbon guide member 21. Whereas in the position as shown in FIG. 3, the spring 27 and magnet 25 apply a force to the ribbon guide member 21 greater than that which the spring 23 applies to the ribbon guide member 21 because the magnet 25 and frame member 24 are adjacent to each other.

Figure 4:
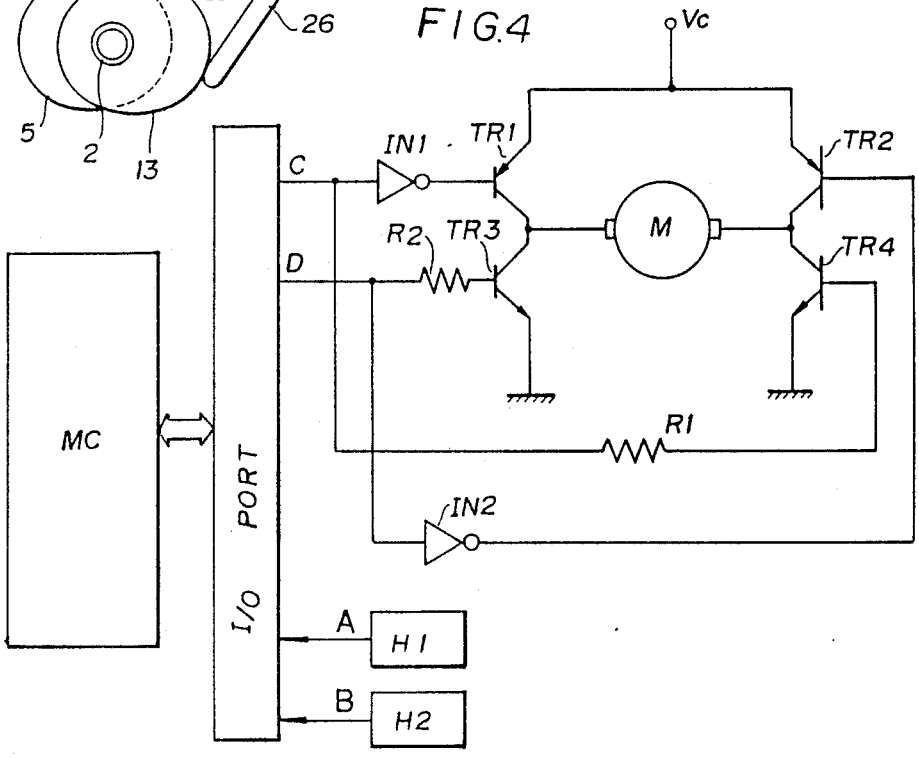
FIG. 4 is a block diagram of the control circuit for the DC motor.
Figure 5:
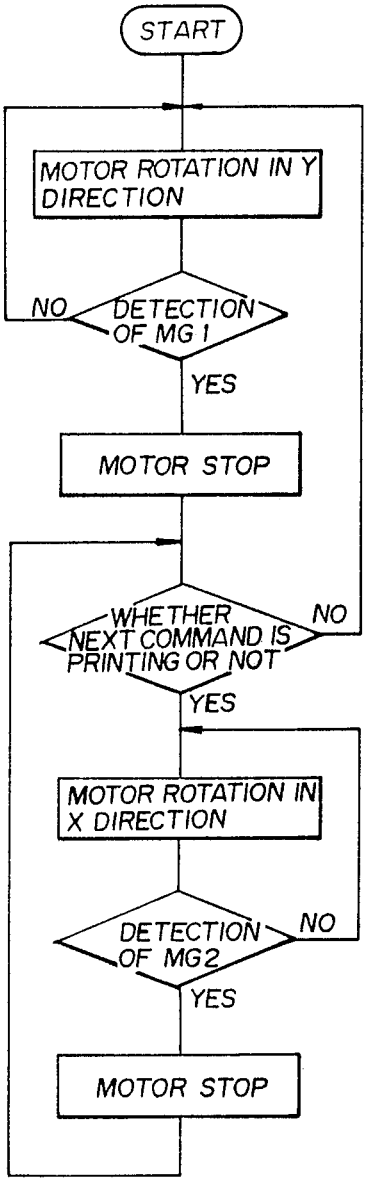
FIG. 5 is a flow chart showing the control function of the microcomputer in said control circuit.

The control circuit for the DC motor M will be now described referring to FIG. 4. In FIG. 4, MC denotes a microcomputer (which will be abbreviated as "micom" hereinafter). The micom MC separately inputs detected voltages from the magnetic sensitive elements H1, H2, (FIG. 1) to the control circuit through an inlet and outlet port (I/O port) and varies H, L levels (high and low voltages) at the terminals A and B of the I/O port so as to control the rotation of the DC motor M in accordance with the flow chart as shown in FIG. 5. The drive circuit of the DC motor M comprises four transistors, that is, PNP type transistors TR1, TR2 the emitters of which have positive voltage Vc applied thereto and NPN type transistors TR3, TR4 the collectors of which are grounded. One terminal of the DC motor M is connected across the collectors of the transistors TR1, TR3 and the other terminal of the motor M is connected across the collectors of the transistors TR2, TR4. The terminal C of the I/O port is connected to the base of the transistor TR1 through an inverter IN1 and to the base of the transistor TR4 through a resistance R1. The terminal D of the I/O port is connected to the base of the transistor TR2 through an inverter IN2 and connected to the base of the transistor TR3 through a resistance R2. When (C, D)=(L, L), all the transistors TR1–TR4 turn OFF and the DC motor M ceases to rotate. When (C, D)=(H, L), only the transistors TR1, TR4 turn ON and the DC motor M rotates in one direction (X direction, for example) and when (C, D)=(L, H), only the transistors TR3, TR2 turned ON and the DC motor M rotates in the other direction (Y direction, for example).

Referring now to the flow chart shown in FIG. 5. After Connection to the power source PS has been made, the DC motor M is first rotated in the direction Y, the magnetic sensitive element H1 detects the magnet MG1 associated with the ratchet gear 7 or the eccentric cam 5 assumes the rotation angle as shown in FIG. 3 whereupon the motor M ceases to rotate. It is then determined whether or not, the next command is to be "printing"; if the printing command is not given, the motor M is allowed to continue to rotate. When the printing command is given, the motor M is rotated in the direction X, the magnetic sensitive element H2 detects the magnet MG2 associated with the magnetic sensitive element H2 or the eccentric cam 13 assumes the rotation angle as shown in FIG. 2 to cease the rotation of the motor M. Thereafter, the procedure returns to the stage where it is determined whether or not the next command is to be printing.

With the above-mentioned construction and arrangement of the components of the inked ribbon operation device in a printer, in operation, when connection to the power source PS is made the motor M begins to rotate in the direction Y and the rotation of the motor M is transmitted through the gears 3, 4 to the shaft 2 which in turn rotates in the direction A. When the shaft 2 rotates in direction A, the ratchet gear 7 and eccentric cam 5 rotate in the direction A because the one-way bearings 6*a* associated with the gear and cam 7, 5 are bearings permitting rotation in the A direction. The ratchet gear 11 and eccentric cams 12, 13 are prevented from rotating in the direction A by the ratchet 14 engaging with the ratchet gear 11 because the one-way bearings 10*a* associated with the gear and cams 11, 12, 13 permit rotation in the B-direction.

Assuming that the ribbon guide member 21 is in its raised position as shown in FIG. 3, by the force of the mutual attraction of the magnetic frame member 24 and magnet 25, as the eccentric distance of the contacting portion 28*b* of the lift arm 28 contacting the eccentric cam 5 increases (see FIG. 2) by the rotation of the shaft 2 in the direction A, since the lift arm 28 rotates about the shaft 28*a* in the clockwise direction (as seen in FIG. 2), the pushing-up portion 28C of the lift arm 28 abuts against the abutment 21*a* of the ribbon guide member 21 to rotate the ribbon guide member 21 in the clockwise direction, whereby the frame member 24 and magnet 25 separate from each other and thus the ribbon member 21 is held in the lowered position as shown in FIG. 2 where the ribbon guide member 21 abuts against the abutment 1*a* on the carriage body 1 by the force of the spring 23 because the moment of the spring 23 in the clockwise direction (FIG. 2) is greater than the moment of the spring 27 in the counterclockwise direction. When the magnetic sensitive element H1 assumes the rotation angle at which the magnetic sensitive element H1 detects the magnet MG1 (the rotation angle of the eccentric cam 5 shown in FIG. 3), the motor M ceases to rotate.

When the printing starts, the motor M (FIG. 1) rotates in the direction X to thereby rotate the shaft 2 in the direction B. The rotation of the shaft 2 in the direction B rotates the ratchet gear 11 and eccentric cam 12 because their one-way bearings 10*a* are of the direction B, but the ratchet gear 7 and eccentric cam 5 do not rotate because the one-way bearings 6*a* associated with the ratchet gear 7 and eccentric cam 5 are of the direction A and they are prevented from rotating in the direction B by the ratchet 8 engaging with the ratchet gear 7.

As the eccentric cam 12 rotates in the direction B, the feed arm 19 rocks in the clockwise direction (as seen in FIG. 1) about the shaft 19*a* in proportion to the increase in the eccentric distance of the contacting area of the eccentric cam 12 where the contacting portion 19*b* of the feed arm 19 makes contact. The pawl 19*c* of the feed arm 19 passes over the crest of one of the ratchet gear teeth 16*a* to engage the next adjacent ratchet gear tooth 16*a*. At this time, the ratchet gear 16 does not rotate in the counterclockwise direction because the ratchet gear 16 is engaged by the ratchet 17. When, as the eccentric cam 12 continues to rotate, the eccentric distance of the contacting area of the eccentric cam 12 where the contacting portion 19*b* of the feed arm 19 makes contact begins to decrease, the feed arm 19 rocks about the shaft 19*a* in the counterclockwise direction (as seen in FIG. 1) whereby the pawl 19*c* on the feed arm 19 engaging with one particular tooth 16*a* on the ratchet wheel 16 pushes the tooth 16*a* in the left-hand direction (as seen in FIG. 1) to thereby rotate the ratchet gear 16 by one pitch in the clockwise direction (as seen in FIG. 1). As the ratchet gear 16 rotates in the clockwise direction in this manner, the ribbon shaft RS (FIG. 8) connected to the shaft 16*b* of the ratchet gear 16 rotates so as to move the inked ribbon RB trained about the guide frames 21*b*, 21*c* of the ribbon guide member 21.

Also, the rotation of the eccentric cam 13 in the direction B rotates the link 26, having its contact area 26*a* engaging the cam face of the eccentric cam 13, about the shaft 22 in the counterclockwise direction (as seen in FIGS. 2 and 3). As the eccentric distance of the contacting area on the face of the cam 13 increases, the link 26 imparts moment to the ribbon guide member 21 on the counterclockwise direction against the force of the spring 23. Thus, the frame member 24 fixed to the ribbon guide member 21 approaches the magnet 25 until the frame member 24 is attached to the magnet 25 by the magnetic force provided by the latter. However, at this time, since the moment imparted to the ribbon guide member 21 by the magnet 25 in the counterclockwise direction (as seen in FIG. 3) is greater than that applied to the ribbon guide member 21 by the spring 23 in the clockwise direction (as seen in FIG. 3), the ribbon guide member 21 is held in the position as shown in FIG. 3 or the ribbon RB is held in the raised position or printing zone defined by the opposing platen P and printing means PM. When the magnetic sensitive element H2 assumes the angle of rotation at which the element detects the magnet MG2 (the angle of rotation of the eccentric cam 13 as shown in FIG. 2), the motor M ceases to rotate.

Since the ratchet gear 11 and eccentric cams 12, 13 make one complete rotation each time the printing operation is conducted, if successive printing operations are continuously conducted, the ratchet gear 16 rotates in the clockwise direction (as seen in FIG. 1) by the number of pitches equal to the number of letters to be printed in response to the rotation of the eccentric cam 12, and the ribbon RB is fed by the amount corresponding to the rotation amount of the ratchet gear 16. However, the rotation of the eccentric cam 13 imparts moment to the ribbon guide member 21 only in the counterclockiwse direction (FIG. 3) through the link 26 and spring 27, and the ribbon guide member 21 is continuously held in the position as shown in FIG. 3.

When the printing operation has been completed, the motor M begins to rotate in the direction Y whereby the ribbon guide member 21 is urged to rotate in the clockwise direction (FIG. 2) by the action of the eccentric cam 5 and lift arm 28 as mentioned hereinabove and thus, the ribbon RB descends from the printing zone.

Figure 6:
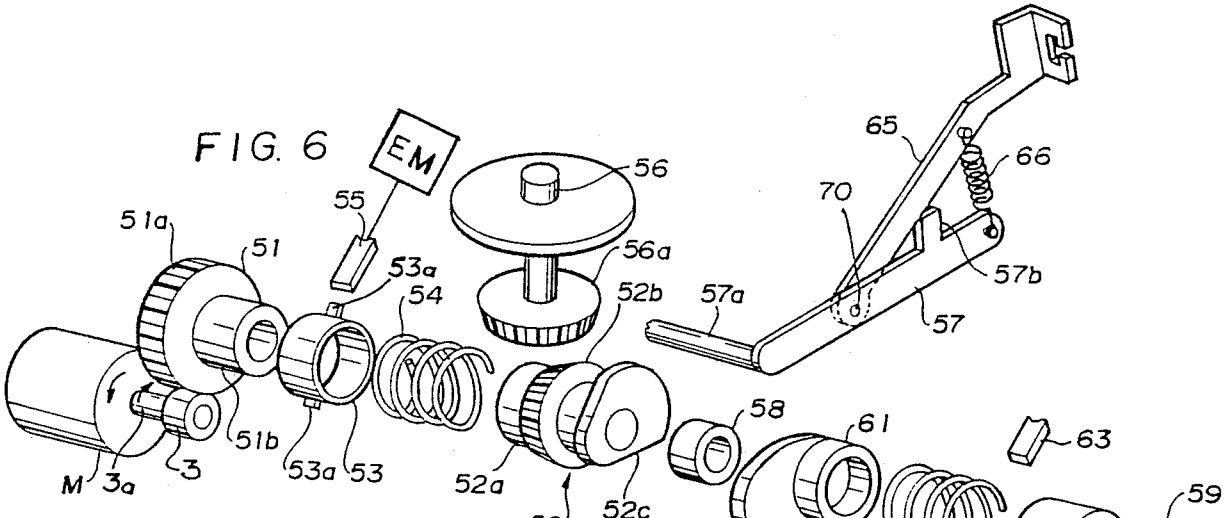
FIG. 6 is a fragmentary exploded perspective view of a second embodiment of the inked ribbon operation device constructed in accordance with the principle of the present invention.
Figure 7:
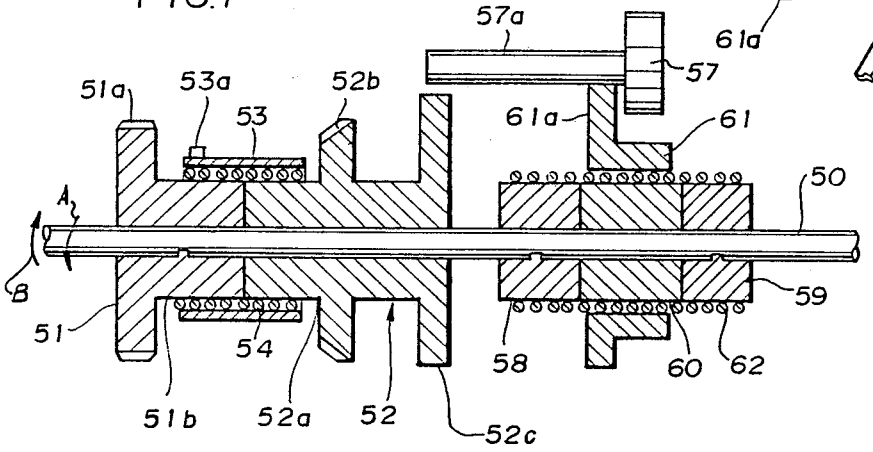
FIG. 7 is a longitudinally sectional view showing the components of the device of FIG. 6 in their assembled position.

Another embodiment of the invention is shown in FIGS. 6 and 7.

In FIG. 7, reference numeral 50 denotes a drive shaft supported on the carriage C for rotation about an axis extending along the movement path of the carriage C. One axial end of the drive shaft 50 has a connector member 51 fixedly secured thereto and having a gear portion 51*a* connected to the above-mentioned motor M and a follower member 52 rotating supported thereon in axial alignment with the connector member 51. The opposing ends of the connector member 51 and follower member 52 are formed with reduced diameter connecting portions 51*b*, 52*a* of the same diameter. A hollow cylindrical engaging member 53 is loosely mounted on the connecting portions 51*b*, 52*a* for rotation about the portions 51*b*, 52*a* and has a plurality of circumferentially spaced engaging projections 53*a* (two projections in the illustrated embodiment) on the outer periphery, a coil spring 54 anchored at one end to the engaging member 53 and adapted to tighten itself about the connecting portions 51*a*, 52*a* as the connector member 51 rotates in the arrow direction A, and an electromagnet EM having an anchor or retaining member 55 operable when the electromagnet EM is energized or de-energized whereby the connector member 51, follower member 52, engaging member 53, spring 54 and electromagnet EM form a one-way clutch. When the electromagnet EM is de-energized and the anchor member 55 engages any one of the engaging projections 53*a* on the engaging member 53, the coil spring 54 is relaxed to thereby disengage the connector member 51 and follower member 52 from each other. The follower member 52 is provided with a gear portion 52*b* engaging the gear portion 56*a* on the feed shaft 56 and a cam portion 52*c*. The other axial end of the drive shaft 50 has a pair of axially spaced holding members 58, 59 fixedly secured thereto and having the same diameter outer periphery. A coil spring 62 is freely mounted on the drive shaft 50 between the holding members 58, 59 and has the same outer diameter as the outer periphery of the holding members 58, 59. When the drive shaft 50 rotates in the arrow direction A, the coil spring 62 tightens itself against the holding member 58 whereas the rotation of the drive shaft 50 in the direction opposite from the arrow direction A causes the coil spring 62 to tighten itself against the holding member 59. An operation member 61 is held about the outer periphery of the interlocking member 60 with the coil spring 62 interposed therebetween and the operation member 61 includes a cam portion 61*a* having a larger diameter and a smaller diameter portion. The two holding members 58, 59, interlocking member 60, coil spring 62 and stoppers 63, 64 fixedly secured to the carriage C for engaging the opposite ends of the coil spring 62 provide a two-way clutch. A link 57 is rockably mounted at an intermediate point between the opposite ends thereof on a shaft 70 parallel to the drive shaft 50 and has a pin 57*a* facing the outer periphery of the cam portions 52*c*, 61*a* of the follower member 52 and operation member 61. A ribbon guide member 65 is pivoted at one end to the shaft 70. An engaging portion 57*b* extends uprightly from the link 57 between the leading end thereof and the shaft 70 and a spring 66 extends between and is anchored to the link 57 and guide member 65 to normally resiliently urge the pin 57*a* against the cam portions 52*c*, 61*a*, respectively.

With the above-mentioned construction and arrangement of the components of the second embodiment of the inked ribbon operation device of the present invention, with the rotation of the motor M in the forward direction, the anchor or retaining member 55 disengages from the engaging projection 53*a* and the follower member 52 rotates following the rotation of the connector member 51. Since the rotational direction of the interlocking member 60 (the arrow direction A) is the tightening direction of the coil spring 54, this rotates the feed shaft 56 which is connected through the gear portions 52*b*, 56*a* to the follower member 52. As the follower member 52 rotates, the cam portion 52*c* on the follower member 52 rocks the link 57 about the shaft 70 whereby the ribbon RB is moved in the width direction (vertical direction) so that the full width of the ribbon RB can be utilized for printing. The energizing time of the electromagnet EM is so set that the anchor member 55 engages the projections 53*a* in succession and the follower member 52 is intermittently driven to feed the ribbon RB. When the motor M rotates in the reverse direction X, the interlocking member 60 rotates in response to the rotation of the motor M in direction B (i.e. in the direction opposite to that of the arrow A), that is, in the direction for relaxing the coil spring 54. The connector member 51 and follower member 52 are disengaged from each other. Then, since the rotational direction (the direction opposite to the arrow direction A) of the drive shaft 50 is that in which the coil spring 62 tightens itself about the holding member 59, the interlocking member 60 makes one complete rotation in the same direction (the reverse direction B). When the cam portion 61*a* of the interlocking member 60 moves until the larger diameter portion thereof engages the pin 57*a*, the cam portion 61*a* raises the pin 57*a* to its predetermined maximum extent and rotates the link 57 in the clockwise direction as seen in FIG. 6 so as to move the guide member 65 downwardly away from the printing zone so that the line of printed letters on the printing medium can be viewed. At this time, one end of the coil spring 62 engages one of the stoppers 63 and the coil spring 62 relaxes to disengage the interlocking member 60 from the holding member 59 resulting in stoppage of the interlocking member 60.

When the motor M is rotated in the forward direction Y, since the rotation direction of the drive shaft 50 is that in which the coil spring 62 fastens itself about the holding member 58, the interlocking member 60 rotates in the same direction (forward direction A). As the interlocking member 60 rotates, the cam portion 61*a* thereof moves so as to face the pin 57*a* and so as to cause the pin 57*a* to engage the cam face on the cam portion 52*c* of the follower member 52 again, whereby the guide plate 65 faces the front of the printing zone through the link 57. At this time, the other stopper 64 engages the other end of the coil spring 62 to relax it so as to interrupt the engagement between the interlocking member 60 and holding member 58, thus resulting in stoppage of the interlocking member 60.

As is clear from the foregoing description, according to the present invention, by the use of two clutch means, such as one-way bearings 6*a*, 10*a* when the DC motor M rotates in one direction the ribbon RB is fed and when the motor M rotates in the other direction the ribbon RB is lifted. As compared with the conventional inked ribbon operation device in which the feeding and lifting of the ribbon are performed by separate means, the number of parts can be reduced, the construction can be simplified and cost can be cut.

In the above-mentioned embodiments, the DC motor M is mounted on the carriage C. In order to reduce the weight of the carriage C, the DC motor M may be disposed outside of the carriage as shown, for example, in Japanese Patent Application No. 42572/1979, and the shaft 2 and motor M may be connected together by means of a splined shaft.

It is contemplated that the embodiment of the invention illustrated in the drawings may be modified in such a manner as to have the vertical position of the magnet 25 adjusted by an electromagnetic plunger or other means to enable the vertical position of the ribbon guide member 21 to be adjusted in a plurality of stages, i.e. more than three stages, instead of only the two upper and lower stages, and the ribbon guide member 21*b*, 21*c* may be employed as a multi-color ribbon switch mechanism.

It will be apparent to those skilled in the art that various changes may be made in the invention without departing from the spirit and scope thereof.

What is claimed is:

1. An apparatus for use in association with a print ribbon in a printer, said apparatus comprising ribbon guide means for engaging the ribbon and movable between a first position in which said guide means holds the ribbon in a print position and a second position in which said guide means holds the ribbon in a retracted position offset from the print position, a rotatable drive member, reversible motor means connected with said drive member for rotating said drive member in first and second directions, first cam means rotatable with said drive member in the first direction to effect movement of said ribbon guide means from said first position to said second position, second cam means rotatable with said drive member in the second direction to effect movement of said ribbon guide means from said second position to said first position, first retaining means for preventing rotation of said first cam means with said drive member during rotation of said drive member in the second direction, and second retaining means for preventing rotation of said second cam means with said drive member during rotation of said drive member in the first direction.

2. An apparatus as set forth in claim 1 further including magnet means for holding said ribbon guide means in one of said first and second positions during rotation of one of said first and second cam means, said ribbon guide means being movable from said one of said first and second positions to the other of said first and second positions against the influence of said magnet means upon rotation of the other one of said first and second cam means.

3. An apparatus as set forth in claim 1 further including ribbon feed means for effecting a stepwise feeding of the ribbon, and third cam means rotatable with said second cam means for effecting operation of said ribbon feed means during rotation of said second cam means in the second direction.

4. An apparatus as set forth in claim 6 wherein said motor means is operable to rotate said second cam means through a plurality of revolutions in the second direction, said apparatus further including means for holding said ribbon guide means stationary in said first position during rotation of said second cam means through each revolution of the plurality of revolutions after the first revolution of the plurality of revolutions, said third cam means effecting operation of said ribbon feed means to feed an increment of ribbon during each revolution of the plurality of revolutions of said second cam means.

5. An apparatus for use in association with a print ribbon in a printer, said apparatus comprising ribbon guide means for engaging the ribbon and movable between a first position in which said guide means holds the ribbon in a print position and a second position in which said guide means holds the ribbon offset from the print position, ribbon feed means for effecting stepwise feeding movement of the ribbon relative to said guide means, a drive member, motor means for rotating said drive member through a plurality of revolutions in a first direction, first cam means connected with said drive member for rotation therewith through each revolution of the plurality of revolutions of said drive member, means connected with said first cam means and said ribbon guide means for moving said ribbon guide means from the second position to the first position during the first revolution of the plurality of revolutions of said drive member, means for holding said ribbon guide means stationary in the second position during each revolution of the plurality of revolutions of said drive member after the first revolution of the plurality of revolutions, second cam means connected with said drive member for rotation therewith through each revolution of the plurality of revolutions of said drive member, and means connected with said second cam means and ribbon feed means for actuating said ribbon feed means to effect a step of ribbon feeding movement during each revolution of the plurality of revolutions of said drive member.

6. An apparatus as set forth in claim 5 wherein said means for holding said ribbon guide means stationary includes magnet means for magnetically attracting an element to hold said guide means against movement under the influence of magnetic forces between said magnetic means and said element.

7. An apparatus as set forth in claim 5 further including third cam means rotatable by said motor means in a direction opposite to the direction of rotation of said first cam means, and means for moving said ribbon guide means from the first position to the second position upon rotation of said third cam means.

8. An apparatus as set forth in claim 7 further including first retaining means for holding said first and second cam means against rotation during rotation of said third cam means and second retaining means for holding said third cam means against rotation during rotation of first and second cam means.

9. An inked ribbon operation device for a printer comprising:

a carriage having printer means thereon, said carriage being movable in a direction parallel to a platen;

a motor supported on said carriage having a shaft rotatable in a first direction and in a second opposite direction;

a pair of spaced ribbon shafts rotatably supported on said carriage, each of said ribbon shafts having respective opposite ends of an inked ribbon connected therewith;

a guide member for holding the inked ribbon and being supported on said carriage for movement between a print position in which the inked ribbon is disposed adjacent to a print area of the platen and a retracted position in which the inked ribbon is disposed to one side of the print area so that the print area is visible;

ribbon feed means rotatably connected to one of said ribbon shafts for rotating said one ribbon shaft so the inked ribbon is taken up by an amount in proportion to the amount of rotation of said one ribbon shaft;

first control cam means rotatably supported on said carriage for moving said guide member from the print position to the retracted position;

second control cam means rotatably supported on said carriage separate from said first control cam means for moving said guide member from the retracted position to the print position;

third control cam means mounted on said carriage and connected with said second control cam means for rotation therewith to rotate said ribbon feed means;

first coupling means for coupling said shaft of said motor to said first control cam means to rotate said first control cam means relative to said second control cam means in response to rotation of said shaft in the first direction and for disconnecting said shaft from said first control cam means in response to rotation of said shaft in the second direction;

second coupling means for coupling said shaft of said motor to said second and third control cam means to rotate said second and third control cam means relative to said first control cam means in response to rotation of said shaft in the second direction and for disconnecting said shaft from said second and third control cam means in response to rotation of said shaft in the first direction; and motor control circuit means for operating said motor to rotate said shaft in the first direction and for operating said motor to rotate said shaft in the second direction.

10. A device as set forth in claim 9 further including anchor means for holding said guide member in the print position after rotation of said shaft in the second direction and for releasing said guide member for movement to the retracted position in response to rotation of said first cam means during rotation of said shaft in the first direction.

* * * * *

UNITED STATES PATENT AND TRADEMARK OFFICE

CERTIFICATE OF CORRECTION

PATENT NO. : 4,741,638

DATED : May 3, 1988

INVENTOR(S) : Okabayashi, Mitumasa

It is certified that error appears in the above-identified patent and that said Letters Patent are hereby corrected as shown below:

Column 9, line 32, change "6" to -- 3 --.

Signed and Sealed this

Third Day of January, 1989

*Attest:*

DONALD J. QUIGG

*Attesting Officer*

*Commissioner of Patents and Trademarks*